United States Patent [19]

Sooter

[11] 4,385,980

[45] May 31, 1983

[54] COAL TREATING PROCESS

[75] Inventor: Matthew C. Sooter, Ponca City, Okla.

[73] Assignee: Conoco Inc., Ponca City, Okla.

[21] Appl. No.: 238,296

[22] Filed: Feb. 26, 1981

[51] Int. Cl.[3] ..... C10G 1/00; C10G 9/14

[52] U.S. Cl. ..... 208/8 LE; 208/131

[58] Field of Search ..... 208/8 LE, 131

[56] References Cited

U.S. PATENT DOCUMENTS

| | | | |
|---|---|---|---|
| 1,972,944 | 9/1934 | Morrell | 208/8 LE |
| 3,803,023 | 4/1974 | Hamner | 208/131 X |
| 3,956,101 | 5/1976 | Hara et al. | 208/131 X |
| 3,960,701 | 6/1976 | Schroeder | 208/10 X |
| 4,119,525 | 10/1978 | Gray et al. | 208/8 LE |
| 4,210,517 | 7/1980 | Marakami et al. | 208/131 X |
| 4,216,074 | 8/1980 | Simone | 208/131 X |
| 4,292,165 | 9/1981 | Sooter | 208/131 X |

*Primary Examiner*—Delbert E. Gantz
*Assistant Examiner*—William G. Wright
*Attorney, Agent, or Firm*—Richard W. Collins

[57] ABSTRACT

Pulverized coal is slurried with hydrogen donor solvent at atmospheric pressure and fed directly into a coker furnace and coking drum. Overhead products from the coking drum are fractionated, and a portion thereof is hydrogenated and used as donor solvent. Coke is calcined in a vertical shaft calciner, and calcined coke is contacted with steam in the calciner to produce hydrogen. The hydrogen is used to hydrogenate the donor solvent.

4 Claims, 1 Drawing Figure

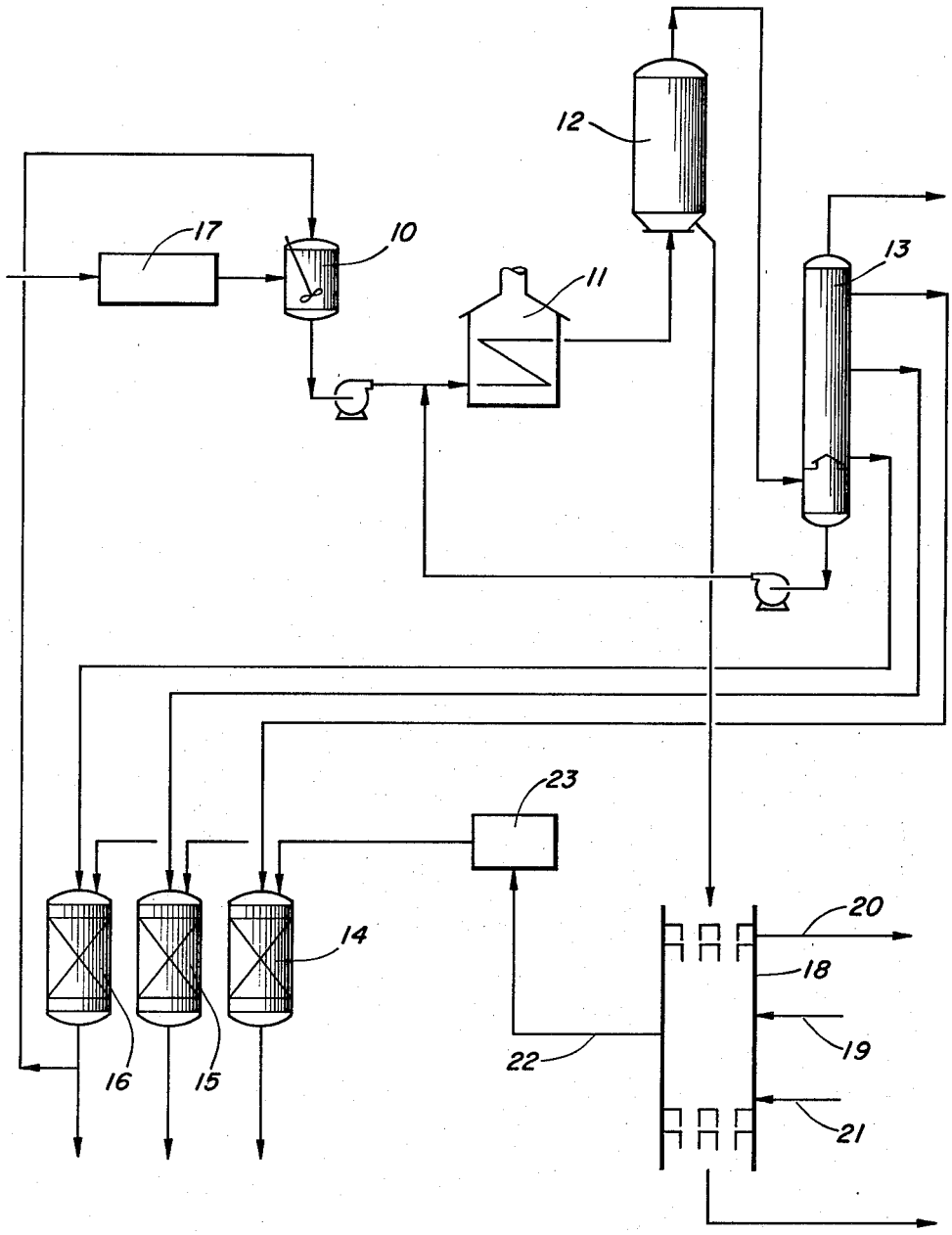
12
17
10
11
13
23
14
20
18
19
22
16
15
21

COAL TREATING PROCESS

BACKGROUND OF THE INVENTION

This invention relates to processing of high sulfur coal, and more particularly to a process of producing low sulfur distillates and low sulfur metallurgical type coke from a high sulfur coal.

Numerous processes are available for liquifaction of coal. These processes, exemplified by U.S. Pat. Nos. 3,966,585 and 3,997,422, typically include a digestion step in which particulate coal is partially dissolved in the presence of a hydrogen-rich solvent, followed by a filtration or other solids removal step, finally followed by a coking step. Additional related processes are described in U.S. Pat. Nos. 3,966,584; 3,617,513; 3,717,570; 3,726,785; 3,841,991; and 4,085,031. This type of process has been generally uneconomical heretofore because of the difficulties involved in removing finely divided solids from the dissolved coal and because of the severe process conditions required to effect significant sulfur removal.

Another approach is described in U.S. Pat. No. 3,960,701, which describes a process of reacting crushed coal in a hydrogenation reactor followed by removal of an oil-solids product stream which is subsequently coked in a delayed coker. Solids removal prior to coking is indicated to be unnecessary, but the coal dissolution step in that process is conducted under severe pressure and temperature conditions.

A coal liquefaction and coking process is described in my U.S. application Ser. No. 119,322, filed Feb. 7, 1980, now U.S. Pat. No. 4,292,165.

Coal treating processes using a hydrogen donor solvent also require a supply of hydrogen. Prior art processes typically required purchased hydrogen for this purpose.

There has been a long-standing need for a process which could treat a high sulfur coal to produce low sulfur liquid and solid products without the difficulties inherent in removing solids from the dissolved coal stream, without the need for purchased hydrogen, and without the necessity of a high temperature and pressure digestor as is required in the prior art. The process of this invention provides this capability.

SUMMARY OF THE INVENTION

According to the present invention, high sulfur coal is pulverized and combined with a hydrogen donor solvent while being maintained at essentially atmospheric pressure. The combined material is passed, without a solids removal step, to a coker furnace where it is heated to coking temperature, typically about 450° to 550° C. From the coker furnace, the heated material is transferred to a delayed coker to produce overhead vapors and solid products. The solid coke product can be desulfurized by high temperature calcination. The process does not require desulfurization of the coker feed, does not require a high pressure dissolver or digester, and does not require filtration of solids from the dissolved coal stream. The elimination of these three difficult steps provides an improved process for obtaining low sulfur coke and liquid products from high sulfur coal.

BRIEF DESCRIPTION OF THE DRAWING

The drawing is a schematic flow sheet illustrating the process of the invention.

DESCRIPTION OF THE PREFERRED EMBODIMENT

The process is applicable to any coal, but is particularly useful for coals having a sulfur content of 2 percent by weight or more. As used herein, the term "high sulfur coal" means a coal having a sulfur content of at least 2 percent by weight.

The process of the invention involves an initial coal preparation step in which coal is subjected to grinding and drying in coal preparation unit 17. The coal is then fed to a slurry mix tank 10 where it is slurried at atmospheric pressure with a hydrogen donor solvent at a temperature low enough to prevent excessive vaporization in the slurry mix tank. Generally, solvent temperatures below about 100° C. are suitable. The amount of solvent utilized is generally from about ½ to 5 parts by weight for each part of coal. Preferably, about 1.5 to 3.0 parts by weight of solvent are used for each part by weight of coal.

The slurry is then pumped to a coker furnace 11 where it is heated to coking temperature, typically about 450° to 550° C. The heated slurry is then passed directly, without any solids removal step, to a coke drum 12 where delayed coke is produced. Overhead vapors from coke drum 12 pass to fractionator 13. Gases and distillates are withdrawn from fractionator 13, and may be subjected to hydrotreating to reduce the sulfur content of the streams.

A naphtha fraction from fractionator 13 passes to hydrotreater 14, a light gas oil stream from fractionator 13 passes to hydrotreater 15, and a heavy recycle gas oil stream passes to hydrotreater 16. Part of the hydrotreated heavy gas oil stream from hydrotreater 16 is recycled to slurry mix tank 10 to provide hydrogen donor solvent for fresh coal feed from coal preparation unit 17. Recycle solvent from the bottom of fractionator 13 may be pumped back to the slurry entering coker furnace 11 if desired.

Delayed coke product from coke drum 12 is taken to vertical shaft calciner 18. Combination air is injected into calciner 18 through line 19 and a high sulfur gas stream is withdrawn through line 20. Steam is injected into the lower part of calciner 18 through line 21 where it reacts with hot calcined coke descending from the combination zone to produce carbon monoxide and hydrogen by the water gas reaction. A hydrogen-rich stream is withdrawn through line 22 below the combustion zone in calciner 18, and desulfurized coke product is withdrawn through the bottom of calciner 18. The temperature in the calcining zone is maintained at from 1450° to 1600° to affect substantial desulfurization of the high sulfur coke descending therethrough.

Carbon monoxide and carbon dioxide may be scrubbed from the product gas stream in scrubber 23, and an enriched hydrogen stream is then utilized for hydrotreating the various streams from fractionator 13 in hydrotreaters 14, 15, and 16. Hydrotreated liquid products are recovered from each of hydrotreaters 14, 15, and 16, and the gas stream from fractionator 13 may also be processed to remove hydrogen sulfide if desired.

I claim:

1. A process for treating coal to produce hydrocarbon liquids and delayed coke therefrom comprising:

(a) combining particulate coal and a hydrogen donor atmospheric pressure and at a temperature below about 100° C.

(b) passing the combined coal and solvent directly, without any solids removal step, to a furnace where the combined material is heated to delayed coking temperature;

(c) passing liquid and undissolved coal from the furnace to a delayed coking drum;

(d) passing vapor from the coking drum to a distillation tower;

(e) recovering green delayed coke from the coking drum and passing the coke to a vertical shaft calciner;

(f) calcining the coke in the upper portion of the calciner;

(g) contacting hot calcined coke with steam in the lower portion of the calciner to produce hydrogen herefrom;

(h) recovering a relcycle gas oil stream from the distillation tower;

(i) utilizing hydrogen produced in the calciner to hydrogenate the recycle gas oil stream; and (j) utilizing the hydrogenated recycle gas oil stream as the hydrogen donor solvent in step (a).

2. The process of claim 1 wherein the coal is a high sulfur coal and the delayed coke is calcined in the calciner at a temperature of from 1450° to 1600° C.

3. The process of claim 1 wherein liquid streams lighter than the recycle gas oil stream are recovered from the distillation tower and are hydrogenated utilizing hydrogen generated in the calciner.

4. The process of claim 1 wherein from 1.5 to 3 parts by weight donor solvent are combined with each part by weight coal.

* * * * *